US009393580B2

(12) United States Patent
Asikkala

(10) Patent No.: US 9,393,580 B2
(45) Date of Patent: Jul. 19, 2016

(54) SURFACE TREATMENT DEVICE AND METHOD

(75) Inventor: Kai Asikkala, Helsinki (FI)

(73) Assignee: BENEQ OY, Vantaa (FI)

( * ) Notice: Subject to any disclaimer, the term of this patent is extended or adjusted under 35 U.S.C. 154(b) by 235 days.

(21) Appl. No.: 14/130,435

(22) PCT Filed: Jun. 29, 2012

(86) PCT No.: PCT/FI2012/050689

§ 371 (c)(1),
(2), (4) Date: Dec. 31, 2013

(87) PCT Pub. No.: WO2013/004907

PCT Pub. Date: Jan. 10, 2013

(65) Prior Publication Data

US 2014/0134348 A1 May 15, 2014

(30) Foreign Application Priority Data

Jul. 1, 2011 (FI) ..... 20115710

(51) Int. Cl.

| | |
|---|---|
| ***B05B 7/20*** | (2006.01) |
| ***B05B 1/28*** | (2006.01) |
| ***C23C 4/12*** | (2016.01) |
| ***B05D 1/08*** | (2006.01) |
| ***C23C 24/00*** | (2006.01) |
| *B05B 7/06* | (2006.01) |

(52) U.S. Cl.

CPC ... *B05B 7/20* (2013.01); *B05B 1/28* (2013.01); *B05B 7/201* (2013.01); *B05D 1/08* (2013.01); *C23C 24/00* (2013.01); *B05B 7/06* (2013.01); *B05B 7/205* (2013.01)

(58) Field of Classification Search

CPC ..... B05B 1/28; B05B 7/20; B05B 7/201; B05B 7/205; B05B 7/206; B05B 7/208; B05B 7/226; C23C 4/12; C23C 4/124; C23C 4/127; C23C 4/128; B05D 1/08; B05D 1/10; H05H 1/26; H05H 1/34; H05H 1/3405; H05H 1/341; H05H 2001/3457

See application file for complete search history.

(56) References Cited

U.S. PATENT DOCUMENTS 5,372,857 A 12/1994 Browning
5,399,831 A * 3/1995 McGee ..... H05H 1/3405 219/121.45

(Continued)

FOREIGN PATENT DOCUMENTS

CN 1300870 A 6/2001
CN 1426446 A 6/2003

(Continued)

OTHER PUBLICATIONS

Apr. 26, 2012 Search Report issued in Finnish Patent Application No. 20115710 (with translation).

(Continued)

*Primary Examiner* — Darren W Gorman
(74) *Attorney, Agent, or Firm* — Oliff PLC

(57) ABSTRACT

Disclosed is a surface treatment device with a robust nozzle configuration. The device includes a nozzle for ejecting a primary stream of combustible substance to a gaseous atmosphere in an ejection direction; an ignition unit configured to ignite the primary stream in a point of ignition; and an impermeable shield providing a planar surface that is substantially opposite to the ejection direction and has in front of the nozzle a hole that allows passage of the primary stream. The shield is positioned between the nozzle and the point of ignition of the primary stream. The shield is advantageously dimensioned to allow simultaneous passage of the primary stream ejected from the nozzle and a circumferential secondary stream of gas from the gaseous atmosphere via the hole.

11 Claims, 3 Drawing Sheets

(56) References Cited

U.S. PATENT DOCUMENTS

| | | | |
|---|---|---|---|
| 2006/0162497 | A1 | 7/2006 | Kodas et al. |
| 2006/0166057 | A1 | 7/2006 | Kodas et al. |

FOREIGN PATENT DOCUMENTS

| | | | |
|---|---|---|---|
| GB | 1 586 261 | A | 3/1981 |
| JP | A 2010-156009 | | 7/2010 |
| WO | WO 2007/093676 | A1 | 8/2007 |

OTHER PUBLICATIONS

Oct. 25, 2012 Search Report issued in International Patent Application No. PCT/FI2012/050689.

Sep. 18, 2015 Search Report issued in Chinese Patent Application No. 201280032838.8.

* cited by examiner

SURFACE TREATMENT DEVICE AND METHOD

FIELD OF THE INVENTION

The present invention relates to a surface treatment device, and to a surface treatment method according to preambles of the independent claims.

BACKGROUND ART

Surface treatment refers here to a layering process where a surface layer of a substrate is modified by allowing particles to diffuse in the substrate matrix, or where particles are deposited on the surface such that a surface layer is produced on the substrate. Particles used for this kind of surface treatment are typically very small, the mean particle diameter ranging from 10 to 100 nm. Particles of this size are typically generated in a particle synthesis process where precursor chemicals are exposed to a thermal reactor. In the intense heat of the thermal reactor they undergo specific thermochemical and -physical reactions that lead to development of desired particles.

In industrial applications, the particle synthesis process typically incorporates a source element that applies a nozzle for ejecting a combination of precursor substances for surface treatment particles, and a thermal reactor for transforming the combination of precursor substances to a directed particle flow. Typically the thermal reactor is a turbulent hydrogen-oxygen flame into which the nozzle outlet channels from one or more nozzles eject a spray of materials, either mixed together or through separate outlets.

The problem with surface treatment devices is that temperatures necessary to allow efficient deposition of particles are very high, and heat from a flame achieving these temperatures causes an extreme strain to nozzle materials. Under the intense heat of a flame nozzles tend to deteriorate, as a result of which the quality of the emitted particle flow quickly degrades.

SUMMARY

An object of the present invention is thus to provide a method and an apparatus for implementing the method so as to overcome, or at least alleviate the above problem. The object of the invention is achieved by a surface treatment device and surface treatment method, which are characterized by what is stated in the independent claims. The preferred embodiments of the invention are disclosed in the dependent claims.

The invention is based on. placing in from of the nozzle an impermeable shield that provides a planar surface that is substantially opposite to the direction of the ejected stream. In front of the nozzle the shield has a hole that allows passage of the primary stream through the shield. The ejected stream comprises combustible substances that are ignited in order to generate heat needed for particle generation. The shield is advantageously positioned between the nozzle and a point of ignition of the ejected stream. The shield may also be dimensioned to allow simultaneous passage of the primary stream and a secondary stream of gas from surrounding gaseous atmosphere via the hole. An advantage of the invention is that the shield protects the nozzle from the heat of the burning substances.

BRIEF DESCRIPTION OF THE DRAWINGS

In the following, embodiments will be described in greater detail with reference to accompanying drawings, in which.

DETAILED DESCRIPTION OF SOME EMBODIMENTS

The following embodiments are exemplary. Although the specification may refer to "an", "one", or "some" embodiment(s), this does not necessarily mean that each such reference is to the same embodiment(s), or that the feature only applies to a single embodiment. Single features of different embodiments may also be combined to provide further embodiments.

In the following, features of the invention will be described with a simple example of a device architecture in which various embodiments of the invention may be implemented. Only elements relevant for illustrating the embodiments are described in detail. Various implementations of surface treatment methods and devices comprise elements that are generally known to a person skilled in the art and may not be specifically described herein. Configurations of the surface treatment device may be described in operational situations where the defined device elements are adjusted to provide defined flow conditions. Such adjustments of the system elements are apparent from the description and can be made through simple tests and trials by a person skilled in the art.

Figure 1:
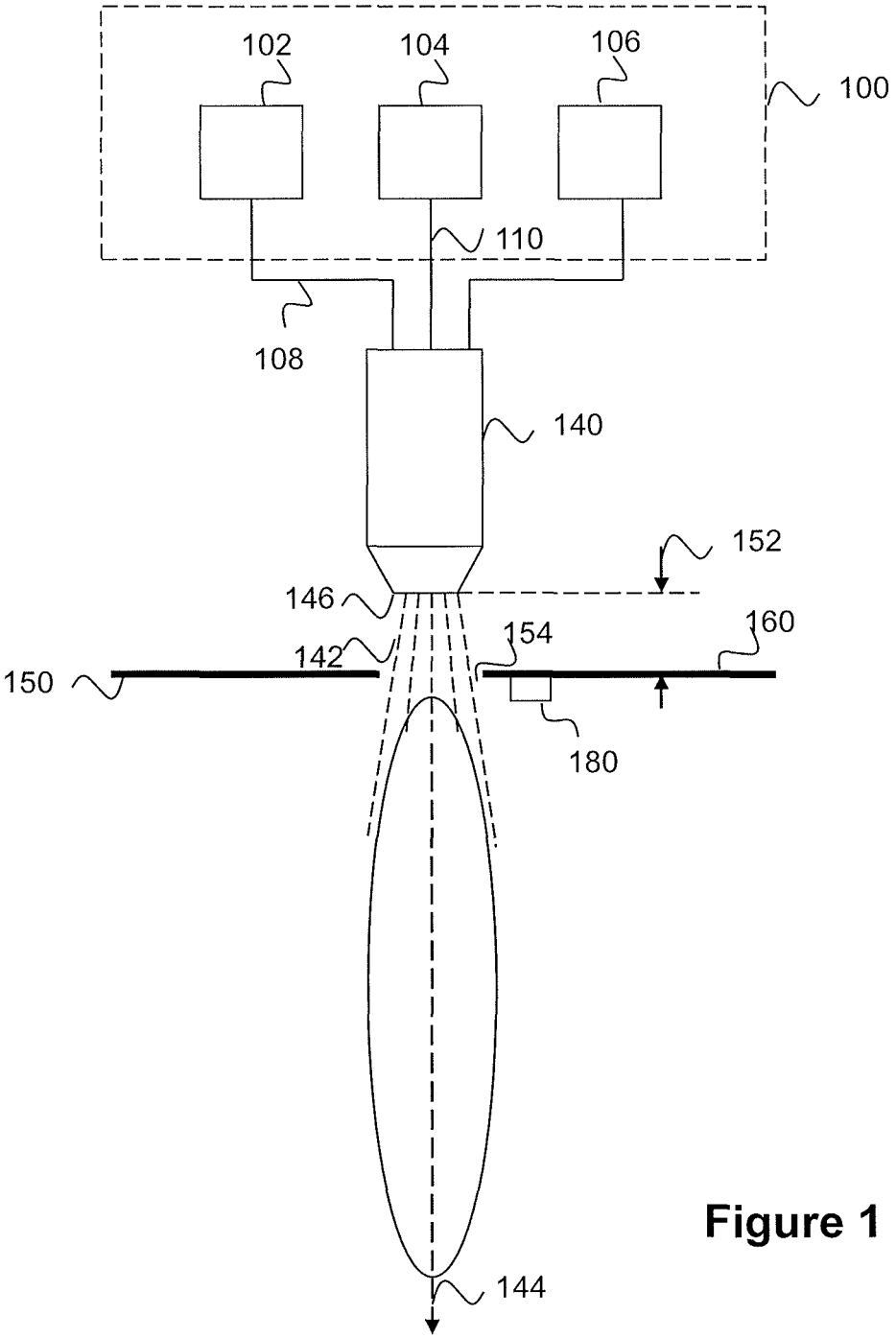
FIG. 1 illustrates an embodiment of a surface treatment device according the invention.

A surface treatment device refers here to an apparatus that generates nanoparticles and directs them towards a surface to be treated. FIG. 1 shows an embodiment of a surface treatment device according the invention. The surface treatment device comprises a source unit 100, and a shield 160. The source unit includes a nozzle for ejecting a combination of precursor substances for surface treatment particles, and means for creating a thermal reactor that transforms the combination of precursor substances to a particle flow. The nozzle represents here an element that generates a directed stream of precursor substances and leads them into a thermal reactor. During use of the surface treatment device the means for creating the thermal reactor provide a local distribution of heat such that objects traversing locations of that distribution are exposed to the heat accordingly.

In the present embodiment, the local distribution of heat is provided by a flame in which the precursor substances traverse. The source unit 100 comprises reservoirs 102, 104, 106 of various precursor substances necessary for the generation of the nanoparticles. In FIG. 1 the reservoirs 102, 104, 106 have been illustrated as storage containers, but for a person skilled in the art it is clear that a reservoir may be implemented also in other ways, for example, as a feed connection from a remote material supply system.

The reservoirs comprise a precursor source 102 that provides one or more precursors of the nanoparticles. Precursors may comprise liquid or gaseous substances. For provision of the thermal reactor, i.e. heat for particle generation, the reservoirs comprise also a source 104 for burning substances. Burning substances refer here to a mixture of one or more combustible fluids that may be ignited to burn in an exothermic process. Combustible fluids typically comprise combustible gases, like hydrogen, methane, propane or butane. The reservoirs may further comprise a source 106 for burn control substances that effect on a burning process, typically in relation to their relative proportion in the space where burning takes place. Burn control substances often comprise an oxygen carrying gas, for example air, oxygen, or ozone. Burn control substances may also comprise one or more inert gases, like nitrogen or carbon dioxide.

The precursor substances, burning substances and burn control substances from their respective reservoirs 102, 104, 106 are efficiently mixed to form a homogeneous combustible fluid that may be ignited to form a flame 190. Mixing may take place in a premixing chamber from which the combustible fluid is outlet, pressurised and fed into a nozzle 140.

Alternatively, mixing may take place in the nozzle 140 itself. For example, before exposing a liquid substance carrying one or more precursors to the thermal reactor, the liquid substance is typically atomized into droplets. Atomization may be performed in a nozzle 140, for example, in a two-fluid atomizing nozzle where gas is used to break up a liquid feed into droplets. The liquid droplets and the atomizing gas form an aerosol that sprays out of the nozzle 140. After exiting from the nozzle, the burning substances ignite into a flame. In the heat of the flame the droplets atomize, and the precursor substances undergo particle generation processes. A combustible gas and/or a burn control gas may be partially fed in as an atomizing gas of the two-fluid atomizer such that inlets 108 and 110 may wholly or partially merge in physical implementations.

Accordingly, the nozzle 140 is configured to eject a primary stream 142 of combustible fluid to a gaseous atmosphere substantially in an ejection direction 144. Gaseous atmosphere refers here to contents of a space surrounding the opening of the nozzle. The nozzle may eject the primary stream 142 into an open space whereby the gaseous atmosphere corresponds to atmospheric air. Alternatively, the nozzle may eject the primary stream 142 into a confined space, the gaseous content of which may be specifically controlled via inlets to and outlets from the space. Ejection direction 144 refers here to a direction of average velocity of the pressurized fluid stream that exits the nozzle. Ejection direction 144 is typically dependent on the direction of the pressure acting on the fluid and/or on the form of the nozzle 140.

In front of the nozzle 140, positioned to a distance 152 from the nozzle 140 is an impermeable shield 160. Impermeable in this context means that fluids (gas and/or liquids) do not substantially penetrate through the shield 160. The shield provides a planar surface 150 that is opposite to the ejection direction. Opposite in this context means that the planar surface 150 is positioned against the primary stream 142 such that it can form a physical barrier that protects the nozzle 140 against flows of fluids and/or heat attempting to arrive from directions directly or obliquely opposite to the ejection direction 144.

The shield 160 is positioned in a distance from the nozzle 140. This forms a gap 152 that allows movement of medium of the gaseous atmosphere to regions between the nozzle 140 and the shield 160. More specifically, dimensions of the nozzle 140 in the ejection direction 144 form a vertical boundary 146 of the nozzle. The vertical boundary 146 of the nozzle represents a surface of points from which the primary stream 142 may be considered to begin. A nozzle may be implemented in various ways and the vertical boundary 146 of the nozzle may vary correspondingly. In case substances are mixed before spraying, the nozzle may have a simple configuration where the liquid mixture exits from one circular endpiece and the vertical boundary 146 corresponds to the outer rim of the endpiece. On the other hand, the nozzle 140 may be configured to comprise a number of source feeds from reservoirs 102, 104, 106 and perform atomization of liquid substances to droplets. In those cases the vertical boundary 146 of the nozzle is naturally more complicated, various parts of the nozzle potentially extending to different lengths in the ejection direction 144. Nevertheless, even in those cases the gap 152 is formed between the planar surface 150 of the shield 160 and the wavy vertical boundary 146 of the nozzle 140.

In order to allow progression of the flow, the shield 160 comprises a hole 154 that is positioned in front of the nozzle 140. The hole is dimensioned such that during operation a primary stream 142 of substances ejected from the nozzle passes through the hole 154. At some point the primary stream 142 ignites and begins to burn in extremely high temperatures. Ignition occurs as a result of a heat source 180 that may be, for example, an igniter, a pilot flame, an ignited particle generation flame or a hot substrate. The point of ignition refers to a position where the exothermic reaction in the primary stream begins, and depends on the temperature and position of the heat source, combustible characteristics of the primary stream and the average velocity of the primary stream 142. Advantageously the point of ignition is adjusted such that the primary stream 142 ignites only after passing through the hole 154. As long as the flame is in the opposite side of the shield, the shield protects the nozzle from radiated heat of the flame.

Figure 2:
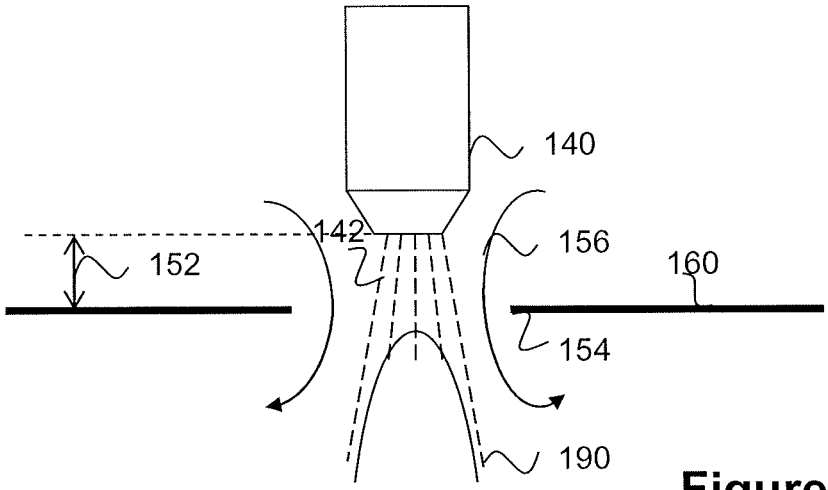
FIG. 2 illustrates a cross-sectional view to the streams around the exemplary nozzle of FIG. 1.

It has also been detected that by defined adjustment of the hole 154 in respect of the gap, the primary stream 142 from the nozzle begins to drag along gas from the surrounding gaseous atmosphere and creates a secondary stream of gas from the gaseous atmosphere. This is illustrated in FIG. 2 that shows a cross-sectional view to the streams around an exemplary nozzle of FIG. 1. A primary stream 142 is a spray of substances that exit from the nozzle 140. The exiting substances form a beam, and the cross-section of the beam varies according to the shape of the opening of the nozzle. Typically the spray expands after exit from the nozzle such that the cross-sectional shape of the beam is maintained but the area of the cross section increases. Accordingly, the shape of the hole 154 corresponds with the cross-sectional shape of the primary stream 142 and the area of the hole is larger than the cross-sectional area of the primary stream.

The secondary stream of gas 156 is a circumferential flow of gaseous medium that surrounds the beam of the primary stream 142 when it passes the shield. During operation, gaseous medium that exists in the gap 152 between the nozzle 140 and the shield 160 is exposed to the drag of the primary stream 142 and in some conditions the gaseous medium and the primary stream begin to flow through the hole in the shield simultaneously. Typically this happens when the velocity of the stream of dragged gas approaches but has not yet reached the velocity of the primary stream. The primary stream accelerates the dragged gaseous medium and the dragged gaseous medium forms a surrounding stream that flows with the primary flow 142 though the hole 154, and protects the nozzle 140 and also the shield 160 from the intense heat of the flame 190. Experiments have shown that the effect of the protective secondary stream is remarkable and it significantly lengthens the lifetime of the critical components of the source unit.

Existence of the secondary stream of gas 156 is dependent on the device configuration and may be achieved by simple adjustment of device properties that affect the flow characteristics of the spray and the surrounding gaseous medium in regions around the hole. Theoretical modeling and computing such flow characteristics is complex, but it has been noted that the protective effect of the secondary stream is so efficient that device configurations applying the secondary stream of gas may be easily achieved and also identified via simple experiments. In a typical design situation, one is given the type of the nozzle and the type of substances to be applied in the device. This means that the size and shape of the beam, and velocity of the substances in the primary stream are fixed. The adjustments may then be made through simple experiments by varying the length of the gap 152, and/or the size of the hole 154. Presence of the secondary stream may be easily determined by performing brief burns where the device is used normally, each burn with a different combination of hold and gap dimensions. If the secondary stream is not achieved, a significant amount of slag forms on nozzle and shield surfaces, and may be detected even visually. When the secondary stream of gas 156 is achieved, its protective effect kicks in and surfaces of the nozzle and the shield remain clean.

In order to efficiently protect the nozzle from the heat of the flame, the size of the hole should be as small as possible. On the other hand, it is known that the hole has to substantially correspond with the shape of the beam formed by the primary stream and be larger than the cross-section of the primary stream in order to create the secondary hole. Optimal dimensioning for the hole is typically achieved by beginning from a hole size in the order of 5% more than the cross-sectional size of the primary stream and increasing the size until the secondary stream is achieved.

It is clear that the given adjustment methods are exemplary; other characteristics affecting the flow conditions around the flow may be easily applied by a person skilled in the art to achieve the secondary stream. Such adjustments are routine test procedures and do not require any undue experimentation from a person skilled in the art.

Figure 3:
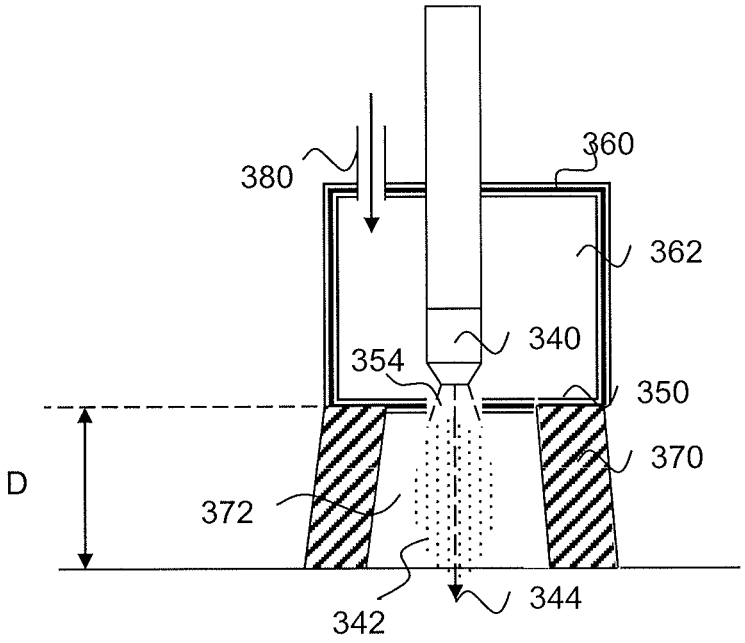
FIG. 3 illustrates a further embodiment of a surface treatment device according the invention.

When the distance to the treated surface is relatively long, there is not much counterpressure from streams after impaction with the treated surface. In some configurations, however, in some configurations the treated surface may need to be close to the nozzle, and the returning streams may compromise the protection provided by the free flow from the gaseous atmosphere. FIG. 3 shows a further embodiment where such impairment of the achieved cooling effect is avoided by increasing the pressure of the gaseous atmosphere. FIG. 3 shows a nozzle 340, this time enclosed into a shield 360 that forms a confined space 362 around the nozzle 340. The confined space 362 provides a gaseous atmosphere into which the primary stream is first ejected. As in the previous embodiment, the shield 360 comprises a planar surface 350 and a hole 354 through which the primary stream 342 traverses towards a treated surface.

In this embodiment, however, the gaseous atmosphere is provided in form of a pressurized gas flow 380 that runs into the confined space 362 surrounding the nozzle 340. The pressure of the gas flow 380 in the confined space 362 may be adjusted to be stronger than the returning streams and thereby maintain a secondary stream that creates an effectively cooling element between the ignited primary stream 342 and structures of the nozzle 340 and the shield 360.

The effective co-operation of the primary stream and the secondary stream may be further enhanced by a flow guide 370 that is attached to or integrated in the shield 360. The flow guide 370 forms a semi-confined space 372, an end wall of which is formed by a region surrounding the hole 354 in an outer wall of the shield 360, and side walls of which extend to a distance D from the end wall. The side walls are advantageously tapered to form a truncated cone that is dimensioned to match with dimensions of the primary stream 342 during operation, but extend horizontally 10-20% further than the primary stream 342. Horizontal direction in this context refers to direction perpendicular to the ejection direction 344. The other end of the flow guide is open. Due to the extended dimensioning, both the primary stream ejected from the nozzle and the secondary stream flowing from the confined space 362 of the shield may traverse unobstructed through the flow guide, and generate a desired uniform flow exiting through the open end of the flow guide 370. The distance D may be adjusted to match with properties of the flame such that particles within the flame are directed on the treated surface in the preferable deposition and collection zone. Location of such zone depends on particle sizes and velocities as well as on adiabatic temperatures of the burning substances, and is easily determined for various substance combinations by a person skilled in the art.

Figure 4:
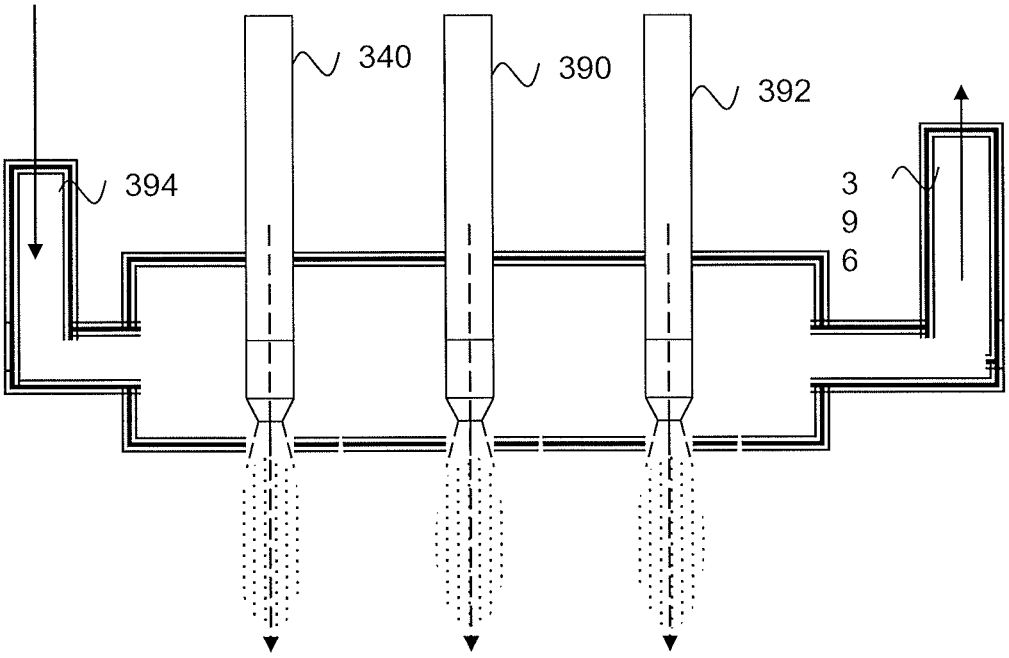
FIG. 4 illustrates yet a further embodiment of a surface treatment device according the invention.

FIG. 4 shows a further embodiment where the surface treatment device is further improved by a shield structure where the pressurized gas flow 380 is provided by a by-pass flow that is made to traverse past the nozzle 340 in a direction transverse to the ejection direction. The by-pass flow creates a convective flow of cooling gas that delivers heat away from the nozzle 340. This further alleviates operating conditions of the nozzle and thereby improves durability of the configuration. Furthermore, one by-pass flow may be directed to a combination of two or more nozzles 340, 390, 392 that are joined into a row. Easy applicability to multiple nozzles facilitates creation of a linear burner that can be moved over a treated surface, thereby speeding up the treating rate of the surface treatment system. In FIG. 4 the by-pass flow providing the pressurized gas flow is implemented by configuring the shield 360 as an elongate casing that may be closed to incorporate the nozzles 340, 390, 392 and arranging an inlet 394 for the cooling gas in one end of the shield 360 and an outlet 396 in the opposite end of the shield.

The gas used to provide the gas flow 380 in FIGS. 3 and 4 may be an inert gas that does not participate in the deposition process or it may comprise one or more of the process gases.

Dimensioning of the hole is made to create defined stream conditions during operation of the surface treatment device. In order to block the radiated heat, the hole is made as small as possible. However, the minimum limit for the hole is provided by the size of the spray at the distance of the shield from the nozzle. For example, in case of a nozzle with a point source, the spray spreads and in a distance the spray has a circular cross-section, the diameter of which depends on the pressure used to create the spray. Dimensioning of the gap for required the drag effect that creates the secondary stream is application-specific and depends on the dimensioning of the hole, the length of the gap, and the applied pressures. Mutual adjustment of the elements routine test procedures for a person skilled in the art.

It will be obvious to a person skilled in the art that, as technology advances, the inventive concept can be implemented in various ways. The invention and its embodiments are not limited to the examples described above but may vary within the scope of the claims.

The invention claimed is:

1. A surface treatment device that comprises:

a nozzle for ejecting a primary stream of combustible substance to a gaseous atmosphere in an ejection direction;

means for igniting the primary stream; and an impermeable shield providing a planar surface that is substantially opposite to the ejection direction and has in front of the nozzle a hole that allows passage of the primary stream; wherein the impermeable shield is dimensioned to allow simultaneous passage of the primary stream ejected from the nozzle and a circumferential secondary stream of gas from the ambient gaseous atmosphere via the hole, and the impermeable shield is positioned between the nozzle and a point of ignition of the primary stream.

2. A surface treatment device according to claim 1, wherein the shield is a planar object positioned substantially rectilinear to the ejection direction.

3. A surface treatment device according to claim 2, wherein the shield is provided by a casing that encloses a confined space around the nozzle.

4. A surface treatment device according to claim 3, wherein the casing comprises an inlet for pressurized gas flow into the confined space surrounding the nozzle.

5. A surface treatment device according to claim 4, further comprising a flow guide attached to or integrated in the shield.

6. A surface treatment device according to claim 5, wherein the flow guide forms a semi-confined space, an end wall of which is formed by a region surrounding the hole in an outer wall of the shield, and side walls of which extend to a distance from the end wall.

7. A surface treatment device according to claim 6, the side walls being tapered to form a truncated cone.

8. A surface treatment device according to claim 7, the side walls extending horizontally 10-20% further than the primary stream.

9. A surface treatment device according to claim 4, wherein the pressurized gas flow is provided by a by-pass flow that is made to traverse past the nozzle in a direction transverse to the ejection direction.

10. A surface treatment device according to claim 9, the shield being an elongate casing that incorporates two or more nozzles.

11. A surface treatment device according to claim 10, wherein the inlet for pressurized gas flow is located in one end of the shield and the shield further comprises an outlet for gas in the opposite end of the shield.

* * * * *